US008043781B2

(12) United States Patent
Imafuku et al.

(10) Patent No.: US 8,043,781 B2
(45) Date of Patent: Oct. 25, 2011

(54) TONER, TWO-COMPONENT DEVELOPER AND IMAGE FORMATION DEVICE

(75) Inventors: Tatsuo Imafuku, Nara (JP); Takahiro Bito, Nara (JP); Takeshi Satoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 602 days.

(21) Appl. No.: 12/184,680

(22) Filed: Aug. 1, 2008

(65) Prior Publication Data

US 2009/0035683 A1 Feb. 5, 2009

(30) Foreign Application Priority Data

Aug. 1, 2007 (JP) ..... 2007-201075

(51) Int. Cl.
*G03G 9/00* (2006.01)

(52) U.S. Cl. ..... 430/111.3; 430/108.1; 430/108.6; 430/108.7; 430/111.31

(58) Field of Classification Search ..... 430/108.1, 430/108.6, 108.7, 111.1, 111.31, 108.8, 111.3
See application file for complete search history.

(56) References Cited

U.S. PATENT DOCUMENTS

| | | | | |
|---|---|---|---|---|
| 6,287,739 | B1 * | 9/2001 | Kawakami et al. | 430/108.7 |
| 7,070,898 | B2 * | 7/2006 | Nakamura et al. | 430/108.8 |
| 2002/0064722 | A1 * | 5/2002 | Endo et al. | 430/108.6 |
| 2003/0157419 | A1 * | 8/2003 | Miyakawa et al. | 430/108.6 |
| 2003/0165762 | A1 * | 9/2003 | Yamazaki et al. | 430/108.7 |
| 2006/0024600 | A1 * | 2/2006 | Sugiura | 430/108.1 |

FOREIGN PATENT DOCUMENTS

| | | | |
|---|---|---|---|
| JP | 2000-81723 | | 3/2000 |
| JP | 2001-356534 | A | 12/2001 |
| JP | 2005-501282 | | 1/2005 |
| JP | 2005-141127 | A | 6/2005 |
| JP | 2005-215237 | A | 8/2005 |
| JP | 2007-4086 | A | 1/2007 |
| JP | 2007-33536 | A | 2/2007 |
| JP | 2007-34268 | A | 2/2007 |
| JP | 2007-65326 | A | 3/2007 |
| JP | 2007-183341 | A | 7/2007 |

OTHER PUBLICATIONS

Japanese Office Action mailed Jul. 21, 2009 in corresponding JP application 2007-201075.

* cited by examiner

*Primary Examiner* — Christopher Rodee
*Assistant Examiner* — Stewart Fraser
(74) *Attorney, Agent, or Firm* — Nixon & Vanderhye P.C.

(57) ABSTRACT

A toner comprising a small-particle diameter external additive having a number average particle diameter of 7 to 20 nm, a large-particle diameter external additive having a number average particle diameter of 40 to 80 nm and a toner particle having a volume average particle diameter of 4 to 7 μm, wherein the large-particle diameter external additive is stuck to the surface of the toner particles in a semi-embedded state and has a rate of liberation of 0.1% by weight or less from the surface of the toner particle.

7 Claims, 5 Drawing Sheets

TONER, TWO-COMPONENT DEVELOPER AND IMAGE FORMATION DEVICE

CROSS-REFERENCE TO RELATED APPLICATION

This application is related to Japanese application No. 2007-201075 filed on Aug. 1, 2007, whose priority is claimed under 35 USC §119, the disclosure of which is incorporated by reference in its entirety.

TECHNICAL FIELD

The present invention relates to a toner, a two-component developer and an image formation device. The toner and the two-component developer according to the present invention may be preferably used for formation devices, such as copying machines, printers and facsimiles, which have a printing function, derived form an electrostatic electrophotographic system.

BACKGROUND ART

The image formation process utilizing the electrostatic electrophotographic system generally involves a charging step, exposure step, transfer step, developing step, peeling step, cleaning step, charge removing step and fixing step. The process of forming an image is carried out in the following manner. First, the surface of a photoconductor driven with rotation is uniformly charged by a charger. Then, the surface of the charged photoconductor is irradiated with laser light by an exposure apparatus to form an electrostatic latent image, in succession, the electrostatic latent image on the photoconductor is developed by a developing device to form a toner image on the surface of the photoconductor. Moreover, the toner image on the photoconductor is transferred to a transfer-receiving material by a transfer device. Thereafter, the transferred toner image is fixed on the transfer-receiving material by heating using a fixing device to form an image. Also, the toner left untransferred on the photoconductor is removed by a cleaning device and recovered to a prescribed recovery section. Moreover, the surface of the photoconductor cleaned is subjected to a charge removing device to remove a residual charge and prepared for the next image formation.

Recently, the use of toners (small-particle diameter toners) having a volume average particle diameter of 7 μm or less have come to be the mainstream in order to improve the reproducibility of dots for the purpose of improving a higher quality image in an image forming device. The small-particle diameter toner has high cohesive force and high adhesion, posing the problem concerning less transfer efficiency when a toner image is transferred to a recording medium from a photoconductor drum.

As the method that solves this problem, a method of adding a large-particle diameter external additive to a toner is disclosed in, for example, the Japanese Unexamined patent publication of No. 2000-81723.

SUMMARY OF THE INVENTION

Accordingly, the present invention provides a toner comprising a small-particle diameter external additive having a number average particle diameter of 7 to 20 nm, a large-particle diameter external additive having a number average particle diameter of 40 to 80 nm and a toner particle having a volume average particle diameter of 4 to 7 μm, wherein the large-particle diameter external additive is stuck to the surface of the toner particles in a semi-embedded state and has a rate of liberation of 0.1% by weight or less from the surface of the toner particle.

Also, the present invention provides a two-component developer comprising a carrier and the above toner, wherein the carrier is a resin coated carrier in which the surface of ferrite particles are coated with a resin layer and which has a volume average particle diameter of 20 to 60 μm.

Moreover, the present invention provides an image formation device comprising a photoconductor capable of forming an electrostatic latent image on its surface, a charger that charges the surface of the photoconductor, an exposure apparatus that forms an electrostatic latent image on the surface of the photoconductor, a developing device that receives a two-component developer containing the above toner and a carrier and supplies the toner to the electrostatic latent image on the surface of the photoconductor to form a toner image, a transfer device that transfers the toner image formed on the surface of the photoconductor to a recording medium, a cleaning device that cleans the surface of the photoconductor and a fixing device that fixes the toner image to the recording medium, which the image formation device forms the toner image by utilizing an electrophotographic system.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed, description.

DETAILED DESCRIPTION OF PREFERRED EMBODIMENTS

If a toner to which a large-particle diameter external additive is added is used in a two-component developer using a carrier whose surface is coated with a resin, there is the problem concerning a gradual reduction in the charge amount of the toner. The inventors of the present invention have made studies concerning its reason and as a result, found that an external additive having a number average particle diameter range from 40 to 80 nm is easily released from the surface of toner particles and that when the two-component developer containing a resin coated carrier is stirred for a long time in a developer vessel, the external additive is easily accumulated (embedded) in the resin layer on the surface of the carrier. It is estimated that the embedding of the external additive allows the formation of innumerable irregularities on the surface of the resin coated carrier and the factional electrification between the carrier and the toner is inhibited, and such a carrier is deteriorated in the ability to electrify a newly loaded toner by the friction thereof, with the result that fogging and toner scattering are caused by electrification inferiors.

Figure 7:
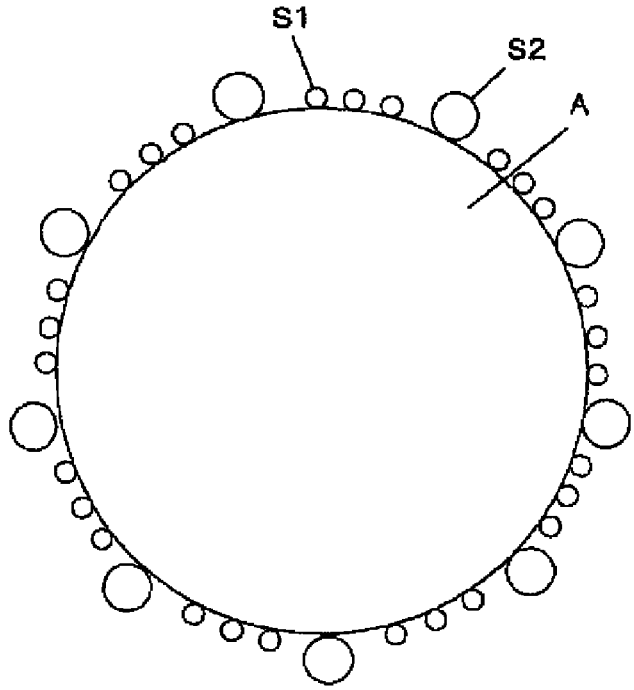
FIG. 7 is a schematic view of the toner of the prior art.
Figure 8:
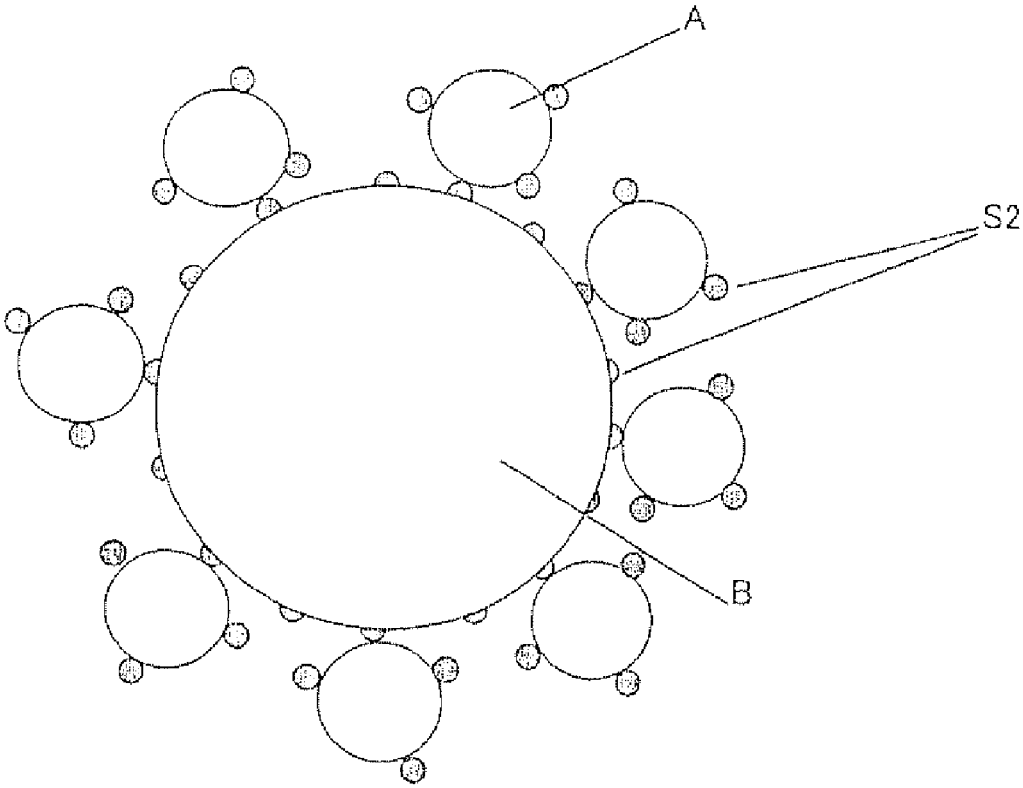
FIG. 8 is a schematic view of the two-component developer, using the toner of the prior art, in long-term use.

FIG. 7 is a conceptional figure showing,that the large-particle diameter external additive is not embedded in but stuck to the surface of the toner in a fluid state. In FIG. 7, S1 means a small-particle diameter external additive, S2 means the large-particle diameter external additive and A means the toner particle. Also, FIG. 8 is a conceptional view showing the two-component developer after the large-particle diameter external additive is accumulated (embedded) in a resin layer on the surface of the carrier. FIG. 8 shows a condition that the large-particle diameter external additive embedded in the resin layer on the surface of the carrier hinders the frictional electrification with the toner. In FIG. 8, B shows the carrier and the small-particle diameter external additive is not shown.

As mentioned above, it has been desired to provide a toner resistant to the release of an external additive from the surface thereof in long-term use.

The present invention can provide a toner that can solve the above problem.

(Toner)

The toner of the present invention will be described.

The toner of the present invention includes a small-particle diameter external additive having a number average particle diameter of 7 to 20 nm, a large-particle diameter external additive having a number average particle diameter of 40 to 80 nm and a toner particle having a volume average particle diameter of 4 to 7 μm. The large-particle diameter external additive is stuck to the surface of the toner particles in a semi-embedded state and has a rate of liberation of 0.1% by weight or less from the surface of the toner particle. The definitions of the number average particle diameter, the volume average particle diameter and rate of liberation are described below.

The semi-embedded state in the present invention refers to a condition when the surface of the toner particles is observed by SEM(scanning electron microscope), the large-particle diameter external additive can be recognized as particles though the large-particle diameter external additive is embedded partly in the toner particles. The condition of the large-particle diameter external additive to the toner particles can be evaluated by measuring the rate of liberation of the large-particle diameter external additive. If the rate of liberation is 0.1% by weight or less, the large-particle diameter external additive is in a semi-embedded state. The semi-embedded state can be attained by stirring the toner particles and the large-particle diameter external additive.

Figure 1:
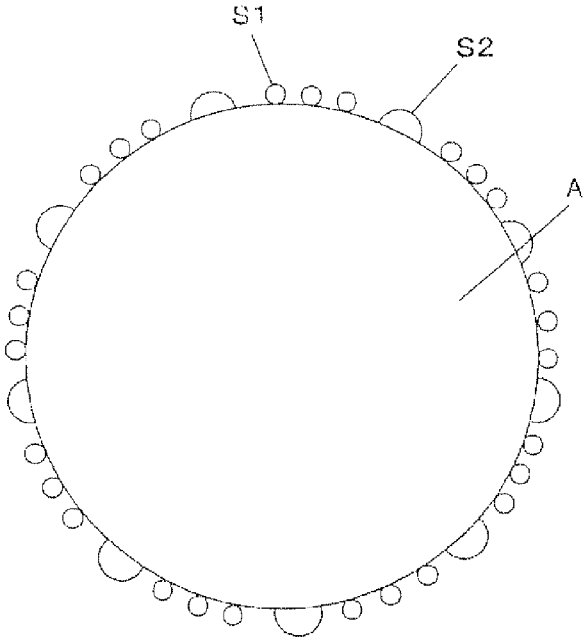
FIG. 1 is a schematic view of the toner of the present invention.
Figure 2:
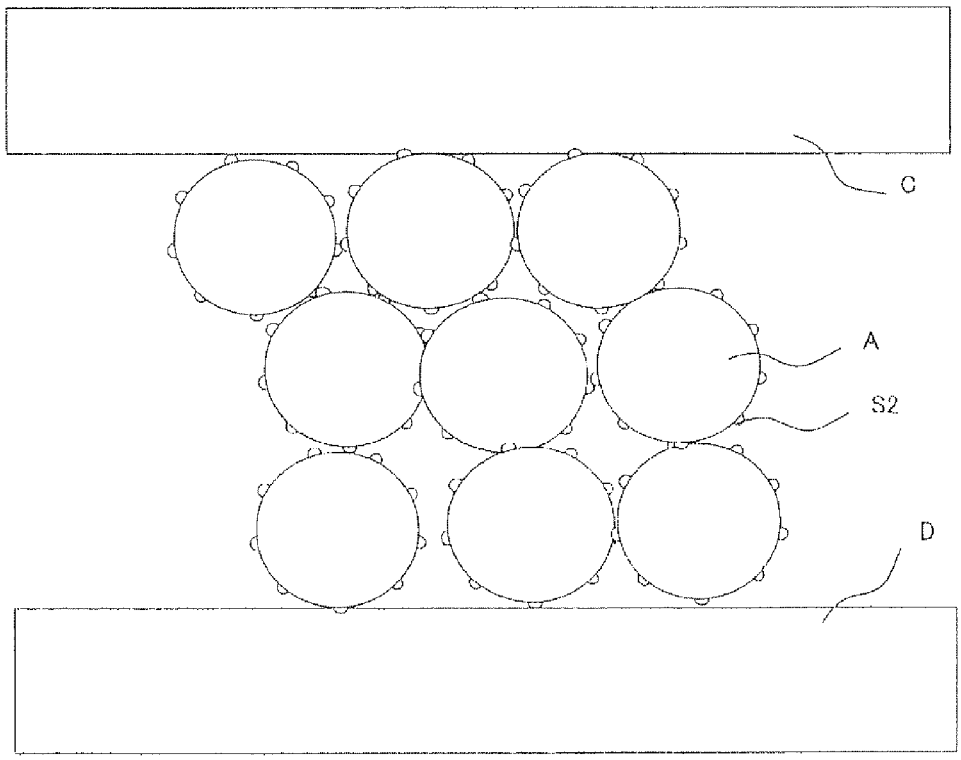
FIG. 2 is a schematic view showing the condition when the toner of the present invention is transferred.
Figure 3:
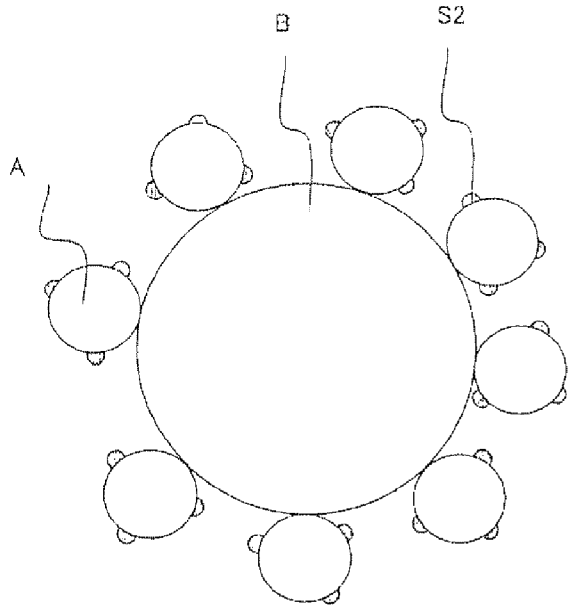
FIG. 3 is a schematic view of the two-component developer, using the toner of the present invention, in long-term use.

The effect of the present invention will be described with reference to FIG. 1. FIG. 1 is a conceptional view showing a sticking condition of the external additive in the initial stage of the toner of the present, invention. In FIG. 1, the small-particle diameter external additive S1 is stuck to the surface of the toner particle A in a fluid state and the large-particle diameter external additive S2 is stuck firmly to the surface of the toner particle A in a semi-embedded state (rate of liberation: 0.1% by weight or less). In such a toner, even if the small-particle diameter external additive S1 is embedded in the surface of the toner particles, the adhesion is reduced by the irregularities of the large-particle diameter external additive S2 (see FIG. 2, the small-particle diameter external additive is not shown) to obtain an effect of improving transfer efficiency. At the same time with this effect, since the large-particle diameter external additive S2 is hardly released from the surface of the toner particle A, the large-particle diameter external additive S2 can be prevented from being accumulated (embedded) in a resin layer of the surface of a carrier B even if a two-component developer containing the resin coated carrier B is stirred for a long period of time in a developer vessel (see FIG. 3, the small-particle diameter external additive is not shown). As a result, the ability to accomplish the frictional electrification to a new loaded toner can be maintained over a long time, thereby making it possible to prevent the occurrences of fogging and toner scattering. In FIG. 2, C represents a photoconductor drum and D represents a transfer medium.

The large-particle diameter external additive added even in a small amount, improves the fluidity and chargeability of the toner. Therefore, the large-particle diameter external additive serves to prevent an occurrence of coagulation and a blocking of toner particles at the toner supply passage and to promote a rise of electrification by stirring the carrier. The amount of the large-particle diameter external additive to be added is preferably 0.5 to 2% by weight. When the amount of the large-particle diameter external additive is less than 0.5% by weight, there is the case where only insufficient fluidity is given to the toner. On the other hand, when the amount of the large-particle diameter external additive exceeds 2% by weight, there is the case where a fixity of the toner is deteriorated. The amount of the large-particle diameter external additive to be added is more preferably 0.7 to 1.5% by weight.

The small-particle diameter external additive serves to reduce the adhesion (Van der Waals force) of the toner by a spacer effect to thereby improve the transfer efficiency when a toner image is transferred to a transfer medium from a photoconductor drum.

The amount of the small-particle diameter external additive to be added is preferably 0.4 to 3% by weight. When the amount of the small-particle diameter external additive is less than 0.4% by weight, the adhesion (Van der Waals force) of the toner by a spacer effect is reduced and there is therefore the case where it is difficult to obtain the effect of improving the transfer efficiency. On the other hand, when the amount of the small-particle diameter external additive exceeds 3% by weight, there is the case where the fixity of the toner is deteriorated. The amount of the small-particle diameter external additive to be added is more preferably 0.8 to 2% by weight.

Even in the case where the amount of the small-particle diameter external additive to be added is smaller (less than 0.4% by weight), the fluidity can be improved by increasing the amount of the large-particle diameter external additive to be added. However, it is necessary that the large-particle diameter external additive be added to the toner in a large amount (exceeding 3% by weight) to impart sufficient fluidity.

The large-particle diameter external additive preferably has a number average particle diameter that is 2 to 12 times as many as that of the small-particle diameter external additive. If the number average particle diameter is in the above range, the adhesion (Van der Waals force) of the toner can be reduced to improve the transfer efficiency. The number average particle diameter is more preferably 4 to 6 times as many as that of the small-particle diameter external additive.

Further, when the coating ratio of the large-particle diameter external additive on the surface of the toner is designed to be 5 to 18%, the transfer efficiency by the spacer effect can be improved. When the coating ratio is less than 5%, there is the case where it is difficult to obtain the effect of improving the fluidity by the external additive. On the other hand, when the coating ratio exceeds 18%, there is the case where the fixity is deteriorated. The coating ratio is more preferably 8 to 15%. The definition of the coating ratio is described below.

Moreover, it is preferable that the small-particle diameter external additive S1 is not embedded in the surface of the toner particles but stuck to the toner particles in a fluid state. The small-particle diameter external additive S1 stuck in this manner can improve the fluidity of a new loaded toner, thereby making it possible to provide good frictional electrification. Here, the fluid state is preferably such a state that the small-particle diameter external additive S1 is stuck to the surface of the toner in the condition of a rate of liberation of 0.5 to 3% by weight. The rate of liberation is more preferably 1 to 3% by weight and even more preferably 1.0 to 2.0% by weight.

The rate of liberation varies depending on a mixing condition of colored resin particles and the external additive and can be adjusted by changing the peripheral speed of a stirring blade of a mixer and an internal temperature of the mixer. As the peripheral speed of the stirring blade is increased, the rate of liberation becomes lower and also, as the internal temperature of the mixer is made higher, the rate of liberation becomes lower. If the peripheral speed of the stirring blade is too high or the internal temperature of the mixer is too high, there is the case where the toner particles coagulate. The peripheral speed of the stirring blade is preferably so designed that the peripheral speed of the top part thereof is in a range from 15 to 100 m/sec. The internal temperature in the mixer is preferably designed to be in a range from ambient temperature to the glass transition temperature of the material composed of the toner particles.

As the external additive, inorganic particles made of such as silica or titanium oxide may be used. Also, these inorganic particles may be surface-treated using a silane coupling agent, a titanium coupling agent or a silicone oil to impart hydrophobic properties to these inorganic particles. Particularly, silica fine particle in which a. trimethylsilyl group is introduced into the surface thereof by using hexamethylsilazane (hereinafter referred to as HMDS) as a silane coupling agent is superior in hydrophilic properties and insulation properties. The toner to which these silica fine particle are added as an external additive can provide excellent chargeability even in a high-temperature environment.

Specific examples of the external additive include such as Aerosil 50 (number average particle diameter: about 30 nm), Aerosil 90 (number average particle diameter: about 30 nm), Aerosil 130 (number average particle diameter: about 16 nm), Aerosil 200 (number average particle diameter: about 12 nm), Aerosil 300 (number average particle diameter: about 7 nm) and Aerosil 380 (number average particle diameter: about 7 nm) manufactured by Japan Aerosil Co., Ltd., Aluminum Oxide C (number average particle diameter: about 13 nm) and MOX 170 (number average particle diameter: about 15 nm) manufactured by Degussa, Germany, TTO-51 (number average particle diameter: about 20 nm) and TTO-55 (number average particle diameter: about 40 nm) manufactured by Ishihara Sangyo Co., Ltd., and silica fine particle (number average particle diameter: about 40 nm, about 60 nm and about 80 nm) surface-treated by hexamethyldisilazane manufactured by Shin-Etsu Chemical Co., Ltd.

As the silica, fine particle which may be used as the external additive in the present invention, silica fine particle having a volume resistance ranging from $1\times10^{12}$ Ω·cm to $5\times10^{15}$ Ω·cm when measured by a compression method are preferable. When the volume resistance is less than $1\times10^{12}$ Ω·m, the amount of charges is easily decreased when the toner is allowed to stand and there is the case where image fogging occurs after the toner is allowed to stand. Additionally, the silica fine particle having a volume average resistance exceeding $5\times10^{15}$ Ω·cm are produced with difficulty, and the cost for the production becomes high. The definition of the volume resistance is described below.

The volume resistance of the external additive can be adjusted by changing the type of a surface treating agent and the amount to be treated. An external additive obtained by treating silica fine particle by using hexamethylsilazane as a silane coupling agent has high resistance and is excellent in hydrophobic ability and stabilizes the charge amount of the toner even in a highly humid environment and is therefore preferable.

Next, materials other than the external additive which may be used in the toner of the present invention will be described.

The toner of the present invention can be produced, for example, by mixing (that is, carrying out treatment using an external additive) the above external additive and the toner particles by using an air flow mixer such as a Henschel mixer. The toner particles are usually made of colored resin particles. The volume average particle diameter of the colored resin particles are preferably in a range from 4 to 7 μm. When the volume average particle diameter is in this range, a high quality image is obtained which is superior in the reproducibility of dots and is reduced in fogging and toner scattering.

The BET specific surface area of the colored resin particles is preferably 1.5 to 1.9 $m^2/g$. When the BET specific surface area exceeds 1.9 $m^2/g$, irregularities are increased on the surface of the colored resin particles, so that the external additive enters into the concave portions and there is therefore the case where the external additive cannot be stuck to the surface uniformly. In this case, the rolling effect (effect of improving the fluidity) and spacer effect (preventing leakage of charges) of the external additive are obtained only insufficiently, bringing about fogging and toner scattering easily. When the BET surface area is less than 1.5 $m^2/g$, there is the case where the surface of the colored resin particles becomes too smooth and there is therefore cleaning inferiors are caused, leading to the generation of fogging.

As a method of controlling the BET specific surface area, a known method may be used. Examples of these known methods include a method in which the colored resin particles are rotated at a high speed in a cylindrical pipe to round the corners of the particles, a suffusion system method in which the toner is instantly melted in a heat air flow or the like. The definition of the BET specific surface area is described below.

The colored resin particles may be produced by a known method such as a kneading milling method, and polymerization method. Specifically, in the case of adopting the kneading milling method, a binder resin, colorant, charge regulator, releasing agent and other additives are mixed by a mixer such as a Henschel mixer, a super mixer, a mechano-mill or a Q-type mixer. The resulting raw material mixture is melted and kneaded at about 100 to 180° C. by a kneader such as a double-shaft kneader or a single-shaft kneader. The obtained kneaded product is cooled and solidified and the solidified product is milled by an air system milling machine such as a jet mill. The obtained milled product is subjected to control the particle diameter such as classification if necessary, whereby colored resin particles can be produced.

As the binder resin which may be used for the toner of the present invention, various known styrene based resins, acryl based resins or polyester resins may be used. Particularly, linear or nonlinear polyester resins are preferable. These polyester resins are excellent in the point that mechanical strength (resistant to the generation of a micropowder), fixity (resistant to peeling from a paper after fixing) and anti-hot offset properties can be attained at the same time.

The polyester resins are obtained by polymerizing monomer compositions made of polyhydric alcohols of divalent or polyvalent and polybasic acids. Examples of a divalent alcohol to be used for the polymerization of the polyester resins include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol, bisphenol A alkylene oxide adducts such as bisphenol A, hydrogenated bisphenol A, polyoxyethylated bisphenol A and polyoxypropylated bisphenol A and others.

Examples of the divalent polybasic acid, may include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid and malonic acid, anhydrides or lower alkyl esters thereof, or alkenyl succinic acids or alkyl succinic acids such as n-dodecenylsuccinic acid and n-dodecylsuccinic acid.

As necessary, polyhydric alcohols and polybasic acids of trivalent or polyvalent may be added. Examples of the polyhydric alcohols of trivalent or polyvalent may include sorbitol, 1,2,3,6-hexanetriol, 1,4-sorbitan, pentaerythritol, dipentaerythritol, tripentaerythritol, cane sugar, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and others.

Examples of the polybasic acids of trivalent or polyvalent include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid and anhydrides thereof.

As the colorant which may be used for the toner of the present invention, known pigments or dyes which are usually used for toners may be used.

As specific examples of the colorant, carbon black, magnetite and the like may be exemplified for black toners.

For yellow toners, ace to-acetic acid arylamide based monoazo yellow pigments such as C.I. Pigment Yellow 1, 3, 74, 97 or 98, acetoacetic acid arylamide based disazo yellow pigments such as C.I. Pigment Yellow 12, 13, 14 or 17, condensed monoazo based yellow pigments such as C.I. Pigment Yellow 93 or 155; other yellow pigments such as C.I. Pigment Yellow 180, 150 or 185 and yellow dyes such as C.I. Solvent Yellow 19, 77 or 79 and C.I. Disperse Yellow 164 may be exemplified.

For magenta toners, red and vermilion pigments such as C.I. Pigment Red 48, 49:1, 53:1, 57, 57:1, 81, 122, 5, 146, 184 or 238; and C.I. Pigment Violet 19; and red type dyes such as C.I. Solvent Red 49, 52, 58 or 8 may be exemplified.

For cyan toners, blue type dyes and pigments of copper phthalocyanine and derivatives thereof such as C.I. Pigment Blue 15:3 or 15:4; green pigments such as C.I. Pigment Green 7 or 36 (Phthalocyanine Green) may be exemplified.

The amount of the colorant to be added is preferably about 1 to 15 parts by weight and more preferably 2 to 10 parts by weight based on 100 parts by weight of the binder resin.

As the charge control agent which may be used for the toner of the present invention, known charge control agents may be used.

Specific examples of the charge control agent which impart negative charges may include chromium azo complex dyes, iron azo complex dyes, cobalt azo complex dyes, chromium/zinc/aluminum/boron complexes or salt compounds of salicylic acid or derivatives thereof, chromium/zinc/aluminum/boron complexes or salt compounds of naphtholic acid or derivatives thereof, chromium/zinc/aluminum/boron complexes or salt compounds of benzilic acid or derivatives thereof, long-chain alkyl carboxylates and long-chain alkyl sulfonates may be exemplified.

Examples of the charge control agent that imparts a positive charge may include nigrosine dyes and derivatives thereof, triphenylmethane derivatives, and derivatives of quaternary ammonium salts, quaternary phosphonium salts, quaternary pyridinium salts, guanidine salts and amidine salts.

The amount of these charge control agents to be added is more preferably in a range from 0.1 parts by weight to 20 parts by weight and even more preferably in a range from 0.5 parts by weight to 10 parts by weight based on 100 parts by weight of the binder resin.

Examples of the releasing agent which may be used for the toner of the present invention may include petroleum based waxes and modified waxes thereof, for example, synthetic waxes such as polypropylene and polyethylene, or paraffin wax and derivatives thereof and macrocrystalline waxes and derivatives thereof and vegetable based waxes such as carnauba wax, rice wax and candelilla wax. If these releasing agents are contained in the toner, the releasability of the toner from a fixing roller or a fixing belt can be improved, thereby making it possible to prevent high-temperature/low-temperature offset in the fixing operation. The amount of the releasing agent to be added is not particularly limited, and is usually 1 to 5 parts by weight based on 100 parts by weight of the binder resin.

(Developer)

The toner of the present invention may be used as a one-component developer or may be mixed with a carrier and used as a two-component developer. Among these developers, the two-component developer is preferable from the viewpoint of charge stability.

The mixing ratio of the carrier to the toner is generally 3 to 15 parts by weight based on 100 parts by weight of the carrier.

Examples of a method of mixing the carrier with the toner include a method in which, the carrier and the toner are stirred using a mixer such as a Naughter mixer.

The carrier to be used in the present invention is not particularly limited, and a magnetic material having a volume average particle diameter of 20 to 100 μm may be used. When the volume average particle diameter is too small, the carrier moves to a photoconductor drum from a developer roller in the developing step and there is therefore the case where a white void occurs in the obtained image. In addition, when the volume average particle diameter is too large, the reproducibility of dots is impaired and there is the case where a rough image is obtained. The volume average particle diameter of the carrier is more preferably 30 to 60 μm. The definition of the volume average particle diameter is defined below.

As the saturation magnetization of the carrier is decreased, a magnetic brush brought into contact with the photoconductor drum is more softened, and therefore, an image more faithful to an electrostatic image is obtained. However, when the saturation magnetization of the carrier is too low, the carrier is stuck to the surface of the photoconductor drum and the white void phenomenon easily occurs. On the other hand, when the saturation magnetization of the carrier is too high, the magnetic brush is stiffened, which makes difficult to obtain an image faithful to an electrostatic image. Therefore, the saturation magnetization of the carrier is preferably in a range from 30 to 100 emu/g. The definition of the saturation magnetization is described below.

As such a carrier, generally, a coated carrier provided with a coating layer on the surface of magnetic core particles is frequently used.

As the core particles, ferrite based particles are preferable from the viewpoint of chargeability and durability, even though known magnetic particles may be used. As the ferrite based particles, known ferrite particles may be used and examples of the ferrite based particles include particles made of such as zinc based ferrites, nickel based ferrites, copper based ferrites, nickel-zinc based ferrites, manganese-magnesium based ferrites, copper-magnesium based ferrites, manganese-zinc based ferrites or manganese-copper-zinc based ferrites.

These ferrite based particles may be produced by a known method. For example, ferrite raw materials such as $Fe_2O_3$ and $Mg(OH)_2$ are blended with each other and this mixed powder is heated in a heating furnace to calcine the powder. The obtained calcined product is cooled and then milled into particles about 1 μm in size by a vibration mill, and a dispersant and water are added to the milled powder to make a slurry. This slurry is pulverized in a wet system by a wet ball mill and the obtained suspension solution is granulated and dried by a spray drier to obtain ferrite based particles.

As a material (coating material) for a coating layer, known resin materials may be used, and for example, an acryl resin, a silicone resin or the like may be used. Particularly, a coated carrier having a silicone resin as a coating layer is preferable since a boron, compound is resistant to adhesion to the surface of the coated carrier and the charging ability of the toner can be maintained for along period of time.

As the silicone resin, a known one may be used, and examples of the silicone resin include silicone varnishes (trade names: TSR115, TSR114, TSR102, TSR103, YR3061, TSR110, TSR116, TSR117, TSR108, TSR109, TSR180, TSR181, TSR187, TSR144, TSR165 and the like manufactured by Shin-Etsu Chemical Co., Ltd., KR271, KR272, KR275, KR280, KR282, KR267, KR269, KR211, KR212 and the like, manufactured by Toshiba Corporation), alkyd-modified silicone varnishes (trade names: TSR184, TSR185 and the like, manufactured by Toshiba Corporation), epoxy-modified silicone varnishes (trade names: TSR194, YS54 and the like, manufactured by Toshiba Corporation), polyester-modified silicone varnishes (trade names: TSR187 and the like, manufactured by Toshiba Corporation), acryl-modified silicone varnishes (trade names: TSR170, TSR171 and the like, manufactured by Toshiba Corporation), urethane-modified silicone varnishes (trade names: TSR175 and the like, manufactured by Toshiba Corporation), and reactive silicone resins (trade names: KA1008, KBE1003, KBC1003, KBM303, KBM403, KBM503, KBM602, KBM603 and the like, manufactured by Shin-Etsu Chemical Co., Ltd.,).

A conductive material is preferably added to the coating material to control the volume resistance of the carrier. Examples of the conductive material include such as silicon oxide, alumina, carbon black, graphite, zinc oxide, titanium black, iron oxide, titanium oxide, tin oxide, potassium titanate, calcium titanate, aluminum borate, magnesium oxide, barium sulfate and calcium carbonate. These conductive materials may be used either alone or in combinations of two or more kinds.

Among these conductive materials, carbon black is preferable from the viewpoint of producing stability, low cost and less electric resistance. The type of carbon black is not particularly limited, and those having a DBP (dibutyl phthalate) oil absorption amount ranging from 90 to 170 ml/100 g are preferable since they are superior in producing stability. Also, as the carbon black, one having a primary particle diameter of 50 nm or less is superior in dispersibility and is therefore particularly preferable. The used amount of a conductive material may be designed to be 0.1 to 20 parts by weight based on 100 parts by weight of the coating material.

As a method of coating the carrier with the coating material, known methods may be used. Examples of the methods include such as a dipping method in which a carrier is dipped in a solution of a coating material and an organic solvent, a spray method in which the solution is sprayed on a carrier, a fluidized bed method in which the solution is sprayed on a carrier put in a floated state by flowing air and a kneader-coater method in which a carrier and the solution are mixed in a kneader coater and then, the solvent is removed. At this time, a conductive material for controlling resistance value of the coating material may be added together with the coating material in the solution.

(Image Formation Device)

Next, an image formation device according to the present invention will be described.

Figure 6:
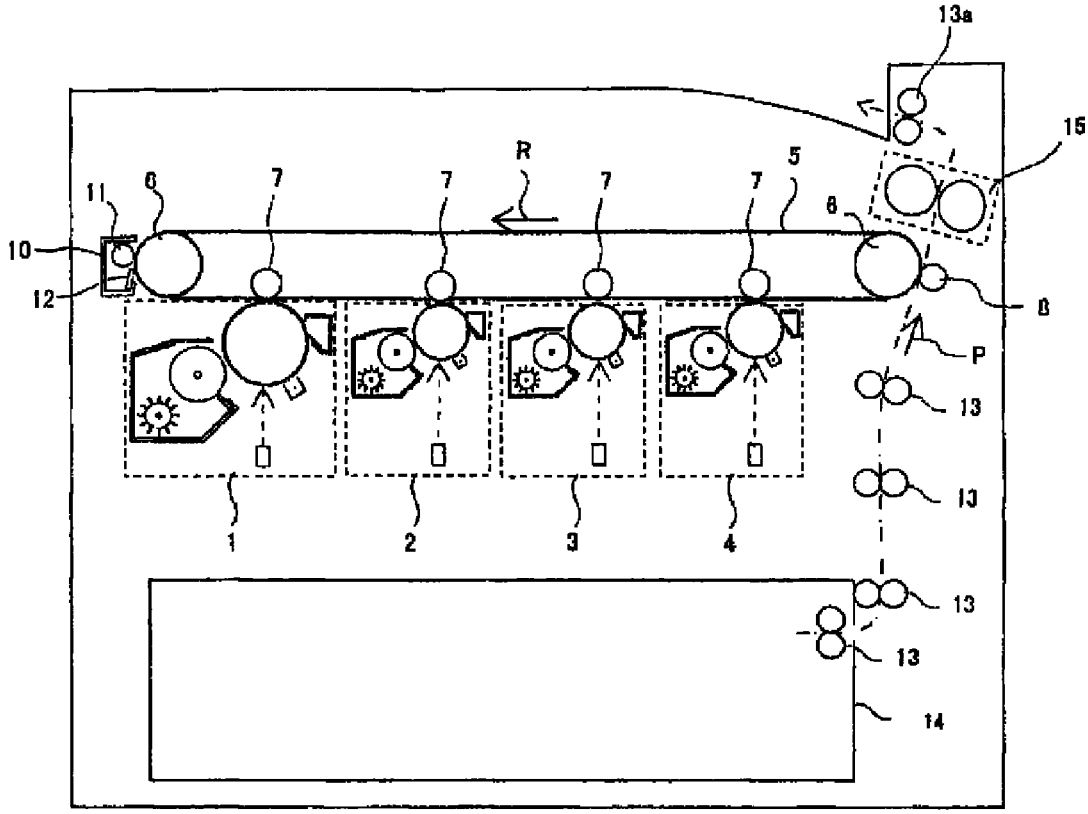
FIG. 6 is a schematic view of the image formation device.

FIG. 6 is an explanatory view showing an embodiment of an image formation device according to the present invention. The image formation device of the present invention is not limited to the structure shown in FIG. 6. As shown in FIG. 6, the image formation device is a tandem system color image formation device provided with four image formation units 1 to 4.

Among these units, the unit represented by the reference symbol 1 is a first image formation unit for forming a black toner image, the unit represented by the reference symbol 2 is a second image formation unit for forming a cyan toner image, the unit represented by the reference symbol 3 is a third image formation unit for forming a magenta toner image and the omit represented by the reference symbol 4 is a fourth image formation unit for forming a yellow toner image.

An intermediate transfer belt (endless belt) 5 is disposed above these four image formation units 1 to 4. The intermediate transfer belt 5 is stretched out in a loop between two support rolls 6 and is designed to rotate in the direction shown by the arrow R. Hereinafter, the expressions of upstream and downstream are made based on the secondary transfer position where a secondary transfer roller represented by the reference symbol 8 is disposed with respect to the direction of the rotation of the intermediate transfer belt 5. As the material of the intermediate transfer belt 5, a material obtained by blending an electro conductive material in an appropriate amount with a resin such as polyimide or polyamide may be used.

The four image formation units 1 to 4 are arranged in the order of the first image formation unit 1 (black), second image formation unit 2 (cyan), third image formation unit 3 (magenta) and fourth image formation unit 4 (yellow) from the upstream side of the intermediate transfer belt 5 in the direction R of the rotation of the intermediate transfer belt 5.

A first transfer roller 7 that transfers a monochromatic toner image formed in each of the image formation units 1 to 4 to the surface of the intermediate belt 5 is disposed opposite to each of the image formation units 1 to 4 inside of the intermediate transfer belt 5. The monochromatic toner images formed in each of image formation units 1 to 4 are transferred to the surface of the intermediate transfer belt 5 in an overlapped manner to form one color image.

A secondary transfer roller 3 that transfers the color image formed on the intermediate transfer belt 5 to a paper (recording medium) is disposed on the downstream side of the fourth image formation unit 4 (yellow) in the direction R of the rotation of the intermediate transfer belt 5.

A belt cleaning unit 10 that cleans the surface of the intermediate transfer belt 5 is disposed on the downstream side of the secondary transfer roller 8 in the direction R of the rotation of the intermediate transfer belt 5. The belt cleaning unit 10 include a belt, cleaning brush 11 which is to be disposed in contact with the intermediate transfer belt 5 and a belt cleaning blade 12. The belt cleaning blade 12 is disposed on the downstream side of the belt cleaning brush 11 in the direction R of the rotation of the intermediate transfer belt 5.

A tray 14 for receiving paper is disposed under the four image formation units 1 to 4. The paper in the toner 14 is conveyed, to the secondary transfer position where the secondary transfer roller 8 is disposed opposite to the intermediate transfer belt 5, by a plurality of paper-feed roller 13. The feed direction of the paper is shown in the arrow P.

A fixing unit 15 for fixing the color image transferred to the paper is disposed on the downstream side of the secondary transfer roller 8 in the feed direction P of the paper. A paper discharge roller 13*a* that discharges the paper to which the color image is fixed from the image formation device is further disposed on the downstream side of the fixing unit 15 in the feed direction P of the paper.

In such a structure, each monochromatic toner image formed in each of the image formation units 1 to 4 is transferred to the surface of the intermediate transfer belt 5 sequentially, to form a color image on the surface of the intermediate transfer belt 5. The color image formed on the surface of the intermediate transfer belt 5 is secondarily transferred to a paper conveyed by the paper feed roller 13 at the secondary transfer position and then, fixed to the paper in the fixing unit 15. The paper to which the color image is fixed is discharged from the image formation device by the paper discharge roller 13*a*. On the other hand, the toner untransferred to the paper and left on the intermediate transfer belt 5 after the secondary transfer operation is removed by the belt cleaning unit 10.

Figure 5:
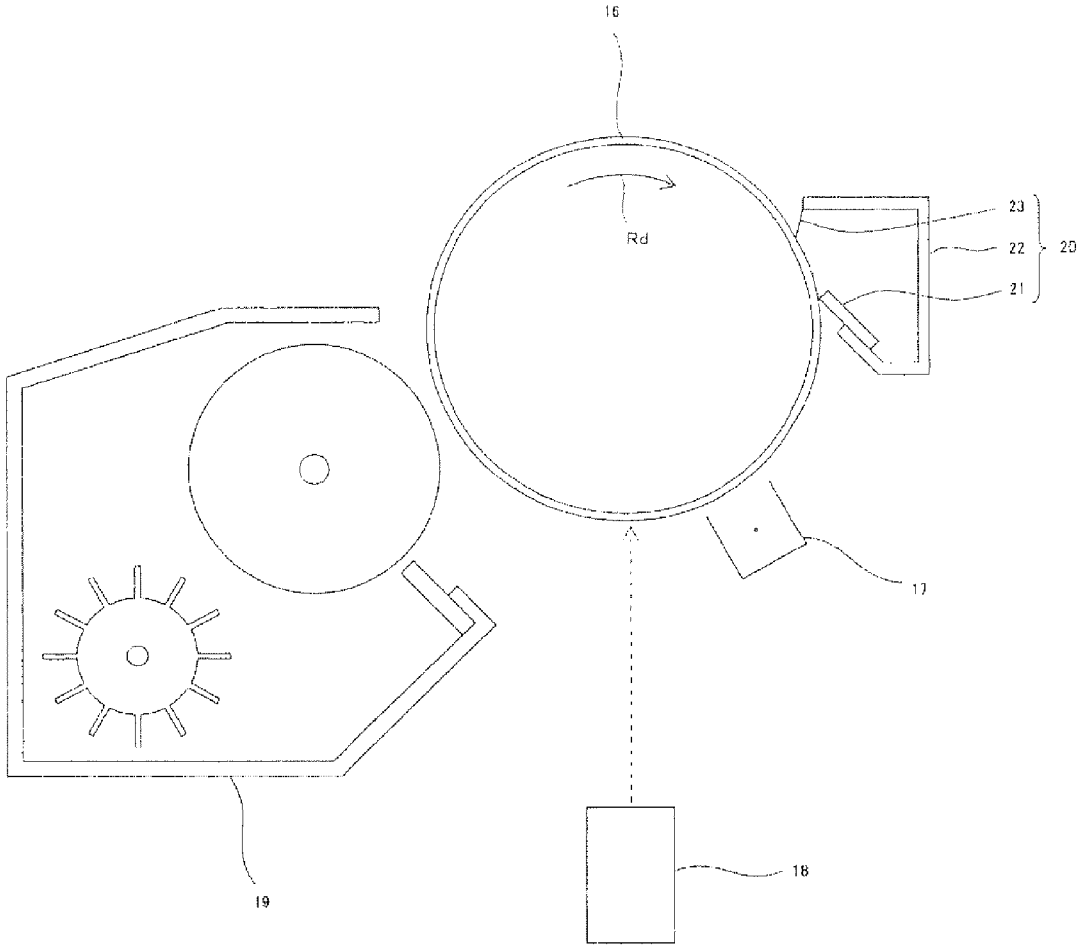
FIG. 5 is a schematic enlarged view of the image formation unit in the image formation device.

FIG. 5 shows the first image formation unit 1 shown in FIG. 6. The structures of the second, third and fourth image formation units 2, 3 and 4 are substantially the same as that of the first image formation unit 1. Therefore, a detailed description of the structures of these second to fourth units 2, 3, and 4 is not given here.

A charger 17 which charges a photoconductor drum 16, an exposure device 18 which writes an electrostatic latent image on the photoconductor drum 16, a developing device 19 which visualizes the electrostatic latent image on the photoconductor drum 16 and a photoconductor drum cleaner 20 which removes residual substances, including toner, left on the photoconductor drum 16 after finishing the first transfer are disposed around the photoconductor drum 16.

The charger 17 is composed of, for example, a scolotron charger and serves to charge the photoconductor drum 16 up to a given potential by conducting corona discharge to the photoconductor drum 16. The charger 17 may be composed of a contact type charger including a colotron charger, a charge roller and a charge brush.

The exposure device 18 is composed of, for example, a laser exposure device and serves to expose the photoconductor drum to light by laser scanning corresponding to image signals to vary the surface potential of the photoconductor drum 16 charged by the charger 17, thereby forming an electrostatic latent image corresponding to image information. As the exposure device, a LED array device and the like may be used.

The developing device 19 receives a developer including the toner of the present invention in the developer vessel and develops the electrostatic latent image formed on the surface of the photoconductor drum 16 by the toner contained in the developer. The developer includes a two-component developer containing a toner and a carrier, a one-component developer which does not contain a carrier but only contains a toner and the like. As this developer, the developer of the present invention may be used.

The photoconductor drum cleaner 20 is provided with a cleaning blade 21, a cleaner housing 22 and a seal 23.

The cleaning blade 21 is disposed in contact with the photoconductor drum 16 in such a manner as to be pressed in the direction opposite to the direction Rd of the rotation of the photoconductor drum 16 to scrape residual substances left on the photoconductor drum 16. The cleaner housing 22 serves to receive the scraped residual substances, and the cleaning blade 21 is set to the cleaner housing 22. The seal 23 serves to seal the inside of the cleaner housing 22, and one end thereof is secured to the cleaner housing 22 and the other is disposed in contact with the photoconductor drum 16 on the upstream side of the cleaning blade 21 in the direction Rd of the rotation of the photoconductor drum 16.

Figure 4:
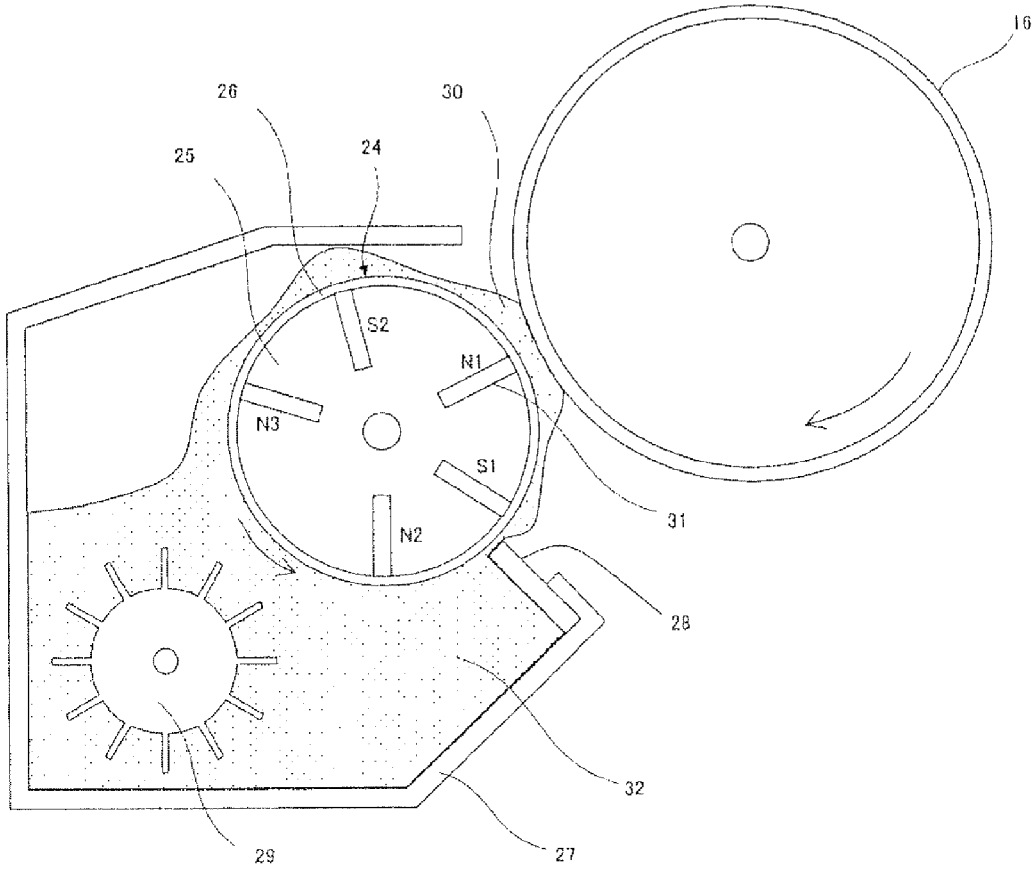
FIG. 4 is a schematic enlarged view of the developer in the image formation device.

FIG. 4 is an explanatory view showing the peripheral structure of the developer 19 shown in FIG. 5. The developing device 19 is provided with a developer vessel 27 that receives a two-component developer 32 (hereinafter, referred to simply as "developer"). The developer vessel 27 is provided with an opening part 30 at a position facing the outside peripheral surface of the photoconductor drum 16.

A developer roller 24 which carries and conveys the developer on its outside peripheral surface to supply the developer to the photoconductor drum 16 to develop the above electrostatic latent image is provided at a position facing the opening part 30 in the developer vessel 27. The developer roller 24 is disposed such that it is spaced from the outside peripheral surface of the photoconductor drum 16.

The developer roller 24 is provided with a multi-polar magnetic member 25 in which magnetic poles N1, N2, N3 and magnetic poles S1 and S1 which are respectively composed of a bar magnet 31 having a rectangular section are radially arranged apart from each other at a plurality of positions in the peripheral directions, and with a nonmagnetic sleeve 26 externally engaged with the multi-polar magnetic member 25 in a rotation-free manner.

Both ends of the multi-polar magnetic member 25 are supported on both side walls of the developer vessel 27 in a nonrotation manner. The magnetic pole N1 (peak value: 110 mT) is disposed at a position towards the rotation center of the photoconductor drum 16, the magnetic pole S1 (peak value: −78 mT) at a position upstream of the magnetic pole N1 and for example, at a position at an angle of 59° with the magnetic pole N1, the magnetic pole N2 (peak value: 56 mT) at a position upstream of the magnetic pole N1 and for example, at a position at an angle of 117° with the magnetic pole N1, the magnetic pole N3 (peak value: 42 mT) at a position upstream of the magnetic pole N1 and for example, at a position at an angle of 224° with the magnetic pole N1 and the magnetic pole S2 (peak value: −80 mT) at a position upstream of the magnetic pole N1 and for example, at a position at an angle of 282° with the magnetic pole N1 are disposed, respectively.

A regulation member 28 which limits the thickness of the developer layer carried on the outside peripheral surface of the developer roller 24 to regulate the amount of the developer to be conveyed to the electrostatic latent image is disposed at a position in the vicinity of the above opening part 30 in the developer vessel 27 and on the upstream side of the developer roller 24 in the feed direction of the developer. The regulation member 28 is disposed at a specified distance from the outside peripheral surface of the developer roller 24.

Also, a stirring member 29 which stirs the developer inside of the developer vessel 27 and supplies the developer to the developer roller 24 is disposed in a rotation-free manner at a position facing the developer roller 24 in the developer vessel 27.

(Various Definitions)

Hereinafter, the definitions of the number average particle diameter, volume average particle diameter, volume resistance, coating ratio, rate of liberation, BET specific surface area and saturation magnetization in this specification will be described.

(Number Average Particle Diameter)

In this specification, the number average particle diameter of the external additive means an average of particle diameters obtained by taking a photograph of the external additive by using a scanning type electron microscope (SEM) and measuring each particle diameter of optional 100 particles of the external additive from the obtained image.

(Volume Average Particle Diameter of the Toner Particles)

In this specification, the volume average particle diameter of the toner particles means a value measured using a 100 μm aperture in a Coulter Multisizer II (manufactured by Beckman Coulter Inc.). As en electrolytic solution used to disperse the toner, an aqueous about 1% NaCl solution using a first class sodium chloride, for example, ISOTON R-11 (Coulter Scientific Japan Inc.) may be used. As a measuring method, 0.1 to 5 ml of a surfactant and preferably an alkylbenzene sulfonate is added as a dispersant in 100 to 150 ml of the aqueous electrolytic solution and a measuring sample is added in an amount of 2 to 20 mg. The electrolytic solution in which the sample is suspended is subjected to dispersing treatment using a ultrasonic dispersing machine for about 1 to 3 minutes. Using the 100 μm aperture in the above measuring device, the volume of the toners and the number of toners are measured to calculate a volume distribution and a number distribution. Then, the intended weight average particle diameter based on weight is found from the volume distribution according to the present invention.

(Volume Average Particle Diameter of the Carrier)

In this specification, the volume average particle diameter of the carrier means a value measured using a dry dispersing machine (RODOS, manufactured by SYMPATEC Co., Ltd.) in a laser diffraction particle distribution measuring device (HELOS, manufactured by SYMPATEC Co., Ltd.) in the condition of a dispersion pressure of 3.0 bar.

(Volume Resistance)

In this specification, the volume resistance of the external additive means a value obtained by measuring in the following procedures. First, the external additive which is allowed to stand in the condition of a temperature of 20° C./and a humidity of 65% for 24 hours is sandwiched between two copper plate electrodes, followed by pressing under a pressure of 10 Kg/cm$^2$ to produce a pressed powder body spaced at a distance of the copper plates electrodes of 8 to 10 mm. Next, a voltage of 500 V/cm is applied across the electrodes to measure the resistance 15 seconds after the voltage is applied, and the measured resistant value is defined as the volume resistance of the external additive.

(Coating Ratio)

In this specification, the coating ratio (surface coating ratio of toner particles) Cg (%) means a value calculated by the following method.

$$Cg=Sg\div St\times 100$$

where:

Sg: Projected area of ail external additives (m$^2$/g)

St: Total surface area of toner particles (m$^2$/g) that is, $$Cg=150\times Wg\div(Bt\times Dg\times Rg)$$

where:

Wg: Amount of the external additive to be added (parts by weight: added amount based on 100 parts by weight of the toner particles)

Bt: BET specific surface area (m$^2$/g) per 1 g of the toner particles

Dg: Primary particle diameter of the external additive (nm)

Rg: Specific gravity of the external additive (g/cm$^2$)

(Rate of Liberation)

In this specification, the rate of liberation means a value measured by the toner analysis method disclosed in Annual meeting of Electrophotographic Society (95 times in total), "Japan Hard copy' 97" Letters, "New method of evaluation of external additives-Toner analysis by particle analyzers", Toshiyuki Suzuki, Toshio Takahara, edited by Electrophotographic Society, Jul. 9 to 11, 1997. Specifically, based on synchronization difference between the counts (number) of emission spectrum along with the excitation of carbon atoms originated from the toner particles and the counts (number) of emission spectrum along with the excitation of, for example, Si atoms originated from silica of an external additive, asynchronous atoms are assumed as free external additives to find its relative ratio as the rate of liberation of the external additive.

As the measuring method, a particle analyzer (PT1000, manufactured by Yokogawa Electric Corporation) is used to measure in the following condition and then, the synchronization of the emission spectrum count of the external additive such as a Si atom based on a C atom is applied to the following equation to find the rate of liberation.

(Measuring Condition of PT1000 Manufactured by Yokogawa Electric Corporation)

Number of C atoms to be detected in one measurement: 500 to 2,500

Noise cut level: 1.5 or less

Sort hours: 20 digits

Gas: $O_2$ 0.1%, He gas

Wavelength for analysis

C atom: 247.860 nm

Si atom: 288.160 nm

Ti atom: 334.900 nm

Others: Each wavelength for analysis of other inorganic elements in the used external additive is used.

Working channel:

C atom: 1 or 2

Si atom: 1 to 4

Ti atom: 1 to 4

Rate of liberation of a Si atom (Number of counts of a Si atom which does not emit light simultaneously with a C atom)/(Number of counts of a Si atom which emits light simultaneously with a C atom+Number of counts of a Si atom which does not emit light simultaneously with a C atom)×100

Sum of rate of liberation of the external additive (Example) In the case of using an external additive containing Si and Ti:

Sum of rate of liberation of the external additive=Rate of liberation of a Si atom+Rate of liberation of a Ti atom (BET Specific Surface Area)

In this specification, the BET specific surface area means a measuring value obtained by the three-point measuring method using a BET specific surface area measuring device (Jemini 2360, manufactured by Shimadzu Corporation).

(Saturation Magnetization)

In this specification, the saturation magnetization means a value measured by VSMP-1 manufacture by Toei Industry Co., Ltd.).

EXAMPLES

Example

<Toner>

A toner for the Example was produced in the following method.

The toner materials are described below.

| | |
|---|---|
| Binder resin (polyester resin obtained by polymerization condensation of bisphenol A propylene oxide, terephthalic acid or trimellitic anhydride as a monomer: glass transition temperature: 60° C., softening point: 115° C., manufactured by Sanyo Chemical Industries Ltd.) | 100 parts by weight |
| Colorant (C.I. Pigment Blue 15:3) | 5 parts by weight |
| Charge control agent (boron compound: LR-147 manufactured by Japan Carlit Co., Ltd.) | 2 parts by weight |
| Releasing agent (Microcrystalline wax: HNP-9, manufactured by Nippon Seiro Co., Ltd.) | 3 parts by weight |

The above toner materials were mixed for 10 minutes by a Henschel mixer and then subjected to melt-kneading-dispersion treatment using a kneading dispersion apparatus (Kneadix MOS140-800, manufactured by Mitsui Mining & Smelting Co., Ltd.). The kneaded product was coarsely crushed by a cutting mill and then pulverized by a jet type crusher (IDS-2 type, manufactured by Nippon Pneumatic Mfg. Co., Ltd.). The pulverized product was classified by a pneumatic classifier (MP-250 type, manufactured by Nippon Pneumatic Mfg. Co., Ltd.) to obtain colored resin particles having a volume average particle diameter of 6.5±0.1 μm and a BET specific surface area of 1.8±0.1 $\mu m^2/g$.

A large-particle diameter external additive (silica fine particle surface-treated with hexamethylsilazane having a number average particle diameter of 40 nm, 60 nm or 80 nm, manufactured by Shin-Etsu Chemical Co., Ltd.) was added to 100 parts by weight of the obtained colored resin particles in the amounts shown in Table 1 and the mixture was stirred by an air flow mixer (Henschel mixer, manufactured by Mitsui Mining & Smelting Co., Ltd.) in which the head speed of the stirring blade was set to 40 m/s for 5 minutes. The obtained mixture particles were observed by a scanning type electron microscope and as a result, the large-particle diameter external additive was stuck to the surface of the colored resin particles in a semi-embedded state.

A small-particle diameter external additive (silica fine particle surface-treated with hexamethylsilazane having a number average particle diameter of 7 nm or 12 nm, manufactured by Japan Aerosil Co., Ltd.) were added to 100 parts by weight of the above mixture particles in the amounts shown in Table 1 and the mixture was stirred by an air flow mixer (Henschel mixer, manufactured by Mitsui Mining & Smelting Co., Ltd.) in which the head speed of the stirring blade was set to 15 m/s for 2 minutes to produce negatively chargeable toners (T1 to T12). The rate of liberation and coating ratio of each of the large-particle diameter external additives and small-particle diameter external additive are also shown in Table 1.

TABLE 1

| | large-particle diameter external additive (40-80 nm) | | | | small-particle diameter external additive (7-20 nm) | | | |
|---|---|---|---|---|---|---|---|---|
| | number average particle diameter (nm) | added amount (wt %) | rate of liberation (wt %) | coating ratio (wt %) | number average particle diameter (nm) | added amount (wt %) | rate of liberation (wt %) | coating ratio (wt %) |
| T1 | 40 | 1.5 | 0.01 | 4 | 7 nm | 0.8 | 0.5 | 43 |
| T2 | 40 | 1.5 | 0.03 | 5 | 7 nm | 0.8 | 0.5 | 43 |
| T3 | 40 | 1.5 | 0.06 | 14 | 12 nm | 1.2 | 0.7 | 38 |
| T4 | 40 | 1.5 | 0.08 | 18 | 12 nm | 1.2 | 0.7 | 38 |
| T5 | 40 | 1.5 | 0.1 | 20 | 7 nm | 0.8 | 0.5 | 43 |
| T6 | 60 | 1.8 | 0.06 | 11 | 7 nm | 0.8 | 0.4 | 43 |
| T7 | 60 | 1.8 | 0.1 | 11 | 12 nm | 1.2 | 0.7 | 38 |
| T8 | 80 | 2 | 0.06 | 11 | 12 nm | 1.2 | 0.3 | 38 |
| T9 | 80 | 2 | 0.04 | 11 | 7 nm | 0.8 | 0.5 | 43 |
| T10 | 80 | 2 | 0.08 | 11 | 7 nm | 0.8 | 2.4 | 43 |
| T11 | 80 | 2 | 0.04 | 11 | 12 nm | 1.2 | 3 | 38 |
| T12 | 80 | 2 | 0.1 | 11 | 12 nm | 1.2 | 3.2 | 38 |
| T13 | — | 0 | 0 | 0 | 7 nm | 0.8 | 0.5 | 43 |
| T14 | 40 | 1.5 | 0.2 | 14 | 7 nm | 0.8 | 0.5 | 43 |
| T15 | 40 | 1.5 | 0.5 | 14 | 7 nm | 0.8 | 0.5 | 43 |
| T16 | 60 | 1.8 | 0.12 | 11 | 7 nm | 0.8 | 0.5 | 43 |
| T17 | 60 | 1.8 | 0.8 | 11 | 7 nm | 0.8 | 0.5 | 43 |
| T18 | 80 | 2 | 0.17 | 9 | 7 nm | 0.8 | 0.5 | 43 |
| T19 | 80 | 2 | 1.2 | 9 | 7 nm | 0.8 | 0.5 | 43 |

<Carrier >

A carrier for the Example was produced in the following methods.

A ferrite raw material (manufactured by Kanto Denka Kogyo Co., Ltd.) was mixed, in a ball mill and then calcined at 900° C. in a rotary kiln and the obtained calcined powder was pulverized into a powder having an average particle diameter of 2 μm or less by using a wet crusher (using a steel, ball as the crushing medium). The obtained ferrite powder was granulated by a spray drying method and the granulated product was calcinated at 1300° C. After calcinating, the granular product was crushed by a crusher to obtain core particles made of a ferrite component having a volume average particle diameter of about 50 μm and a volume resistance of $1\times10^9$ Ω·cm.

Next, a coating solution for coating layer used to form a coating layer that coats the core particles was prepared by dissolving and dispersing 100 parts by weight of a silicon resin (trade name: TSR115, manufactured by Shin-Etsu Chemical Co., Ltd.) and 3 parts by weight of carbon black (manufactured by Evonic Degussa Japan Co., Ltd., primary particle diameter: 25 nm and oil absorption amount: 150 ml/100 g) in toluene.

The prepared coating solution for a coating layer was applied to the core particles made of the ferrite component by a spray coater. After that, toluene was completely removed by vaporization to produce a carrier having a volume average particle diameter of 50 μm, a coating layer thickness of 1 μm, a volume resistance of $2\times10^{10}$ Ω·cm and a saturation magnetization of 65 emu/g.

<Two Component Developer>

The toners (T1 to T12) were respectively blended with the above carrier to produce two-component developers for the Example. These two-component developers were obtained by loading 6 parts by weight of each toner and 94 parts by weight of the carrier in a Naughter mixer (trade name: VL-0, manufactured by Hosokawa Micron Corporation) and stirring the mixture for 20 minutes.

<Evaluation of an Image>

The produced two-component developer and a test image formation device shown in FIG. 6 were used to make a continuous print test. The continuous print test was made using only the image formation unit 1 among four image formation units to conduct tests for the toners T1 to T12. The developing condition of the image formation device was designed such that the peripheral speed of the photoconductor was 400 mm/s, the peripheral speed of the developer roller was 560 mm/s, the gap between the photoconductor and the developing roller was 0.42 mm and the gap between the developer roller and the regulating blade was 0.5 mm, and also, each of the surface potential and developing bias of the photoconductor were regulated such that the amount of the toner to be stuck to a paper in a solid image (100% concentration) was 0.5 mg/cm$^2$ and the amount of the toner to be stuck in a non-image portion was reduced to the minimum. As the test paper, a A4 size electrophotographic paper (Multi-receiver, manufactured by Sharp Document Systems Corporation) was used.

With regards to each toner, 50 K (5000) copies were printed in a print test of a text image in which the coverage of the print image recorded on the paper was 6%.

The evaluation of the image was made by measuring the charge amount of a toner, image density, fogging density and transfer efficiency. The measuring method of each of these test values is described below.

The charge amount of a toner is measured, using a suction type small charge amount measuring device (210 HS-2A, manufactured by Trek Japan Corporation).

The image density is evaluated in the following manner. Specifically, a solid image (100% concentration) in which the length of one side is 3 cm is printed. The image density of the printed part is measured using a reflection type densitometer (RD918, manufactured by GretagMacbeth Company). When the image density is 1.3 or more (fibers of the paper are completely covered with the toner), this is defined as good, when the image density is 1.2 or more and less than 1.3, this is defined as slightly inferior and when the image density is less than 1.2 (fibers of the paper are incompletely covered with the toner), this is defined as inferior.

With regard to the density of fogging, the density of the non-image portion (density 0%) is calculated in the following procedures.

Using a whiteness meter (Z-Σ90 COLOR MEASURING SYSTEM, manufactured by Nippon Denshoku Industries Co., Ltd.), the whiteness of the paper before printing is measured in advance. Next, the whiteness of the non-printed portion of the paper after printing is measured by the whiteness meter to find a difference between the whiteness before printing and the whiteness after printing. This difference is defined as the density of fogging.

When the density of fogging is less than 0.6 (almost no fogging is visually observed), this is defined as good, when the density of fogging is 0.6 or more and less than 1.0, this is defined as slightly inferior and when the density of fogging is 1.0 or more (fogging is visually observed clearly), this is defined as inferior.

The transfer efficiency may be calculated from the weight A of the toner stuck to the surface of the transfer belt and the amount B of the toner stuck to the media according to the following equation.

$$\text{Transfer efficiency } \% = B \div A \times 100$$

<Result>

The results of the continuous print test are shown in Table 2. In the continuous print test of each of the toners T1 to T12, as shown in Examples 1 to 12, the charge amount of the toner was stable and an image which had high image density and no fogging was obtained. Also, the transfer efficiency was as high as 90% or more.

Comparative Example

A large-particle diameter external additive and a small-particle diameter external additive were simultaneously added to 100 parts by weight of the colored resin particles obtained in Example in the amounts shown in Table 1 and the mixture was stirred by an air flow mixer (Henschel mixer, manufactured by Mitsui Mining & Smelting Co., Ltd.) in which the head speed of the stirring blade was set to 15 m/s for 2 minutes to produce negatively chargeable toners (T13 to T19, T13 was added a small-particle size external additive only).

Among the obtained negatively chargeable toners, the toners (T14 to T19) other than the toner (T13) to which the large-particle diameter external additive was not added were observed by a scanning type electron microscope and as a result, the large-particle diameter external additive was stuck to the surface of the colored resin particles in a non-embedded state.

Using the obtained toners, two-component developers were produced in the same manner as in Example and evaluated as to an image in the same method as in Example. The results are shown in Table 2.

<Result>

As shown in Comparative Example 1, the transfer efficiency was dropped in the 50 K copies-continuous print test using the toner T13 without adding large-particle diameter external additive.

Also, as shown in Comparative Examples 2 to 7, the charge amount of the toner was dropped, and fogging and toner scattering occurred in the 50 K copies-continuous print test using the toners T14 to T17.

TABLE 2

| | | initial image | | | image after 50K | | | transfer | |
|---|---|---|---|---|---|---|---|---|---|
| | toner | charge amount (μc/g) | image density | fogging | charge amount (μc/g) | image density | fogging | efficiency (%) | total evaluation |
| Ex. 1 | T1 | 22.5 | good | good | 23.2 | good | good | 90.6 | no problem in practical use |
| Ex. 2 | T2 | 21.3 | good | good | 23.0 | good | good | 91.2 | good |
| Ex. 3 | T3 | 22.9 | good | good | 21.9 | good | good | 93.5 | good |
| Ex. 4 | T4 | 21.6 | good | good | 23.0 | good | good | 93.6 | good |
| Ex. 5 | T5 | 22.7 | good | good | 24.2 | good | good | 94.2 | no problem in practical use |
| Ex. 6 | T6 | 23.0 | good | good | 22.6 | good | good | 92.4 | good |
| Ex. 7 | T7 | 22.5 | good | good | 23.6 | good | good | 93.1 | good |
| Ex. 8 | T8 | 21.9 | good | good | 21.3 | good | good | 91.6 | no problem in practical use |
| Ex. 9 | T9 | 24.1 | good | good | 23.8 | good | good | 90.6 | good |
| Ex. 10 | T10 | 23.5 | good | good | 23.6 | good | good | 90.1 | good |
| Ex. 11 | T11 | 22.1 | good | good | 22.5 | good | good | 93.8 | good |
| Ex. 12 | T12 | 23.8 | good | good | 24.1 | good | good | 93.4 | no problem in practical use |
| Com. Ex. 1 | T13 | 21.6 | good | good | 23.3 | good | good | 82.3 | transfer efficiency was dropped |
| Com. Ex. 2 | T14 | 23.0 | good | good | 18.3 | good | good | 80.6 | toner scattering/charge amount was dropped |
| Com. Ex. 3 | T15 | 22.9 | good | good | 15.6 | good | inferior | 83.5 | toner scattering/charge amount was dropped |
| Com. Ex. 4 | T16 | 23.6 | good | good | 17.6 | good | inferior | 82.9 | toner scattering/charge amount was dropped |
| Com. Ex. 5 | T17 | 22.4 | good | good | 14.9 | good | inferior | 84 | toner scattering/charge amount was dropped |
| Com. Ex. 6 | T18 | 22.5 | good | good | 14.1 | good | inferior | 79.8 | toner scattering/charge amount was dropped |
| Com. Ex. 7 | T19 | 23.2 | good | good | 12.7 | good | inferior | 81.6 | toner scattering/charge amount was dropped |

In the toner of the present invention, a large-particle diameter external additive having a number average particle diameter of 40 to 80 nm which is usually released from the surface of the toner and easily embedded in the surface of a carrier is made to strongly stick to the surface of the toner particles in a semi-embedded state. Therefore, the large-particle diameter external additive is hardly released from the surface of the toner particles and is prevented, from being embedded in the resin layer on the surface of the toner without reducing the spacer effect (transfer efficiency is improved), with the result that fogging and toner scattering are hardly occurred.

Also, the large-particle diameter external additive is stuck to the toner particle in a coating ratio of 5 to 18% and therefore, a more improved spacer effect and transfer efficiency can be obtained.

Moreover, the small-particle diameter external additive has a rate of liberation of 0.5 to 3% by weight from the surface of the toner particles. Therefore, the toner particles have high initial fluidity and therefore, a loaded toner is easily mixed with a carrier. Because of that, a toner which is more superior in frictional electrification and more resistant to fogging and scattering can be provided.

Also, since the small-particle diameter external additive is silica fine particle treated with a silane coupling agent, the humidity dependency of the toner can be more reduced. As a result, a toner showing stable charging properties even under a highly humidity environment can be provided.

Moreover, colored resin particles having a BET specific surface area of 1.5 to 1.9 $m^2/g$ and a smooth surface are used as the toner particles, thereby being able to prevent the external additive from entering into concave portions of the surface of the colored resin particles. As a result, a toner having high fluidity and transfer efficiency can be provided.

Also, in the two-component developer of the present invention, easily releasable large-particle diameter external additive is made to stick strongly to the surface of the toner in a semi-embedded state and therefore, a deterioration in the frictional electrification caused by the embedding of the external additive in the resin layer on the surface of the carrier can be prevented.

Also, since the resin layer of the carrier is a heatcurable silicone resin, the resin layer can be prevented from being softened even if the temperature in the developer vessel is raised. As a result, this can prevent the external additive from being accumulated in the resin layer on the surface of the carrier.

Also, the image formation device of the present invention succeeds in obtaining an image free from fogging and toner scattering through its life because the charge amount of the toner is hardly varied.

What is claimed is:

1. A two-component developer comprising a carrier and a toner comprising a small-particle diameter external additive having a number average particle diameter of 7 to 20 nm, a large-particle diameter external additive having a number average particle diameter of 40 to 80 nm and a toner particle having a volume average particle diameter of 4 to 7 μm, wherein the large-particle diameter external additive is stuck to the surface of the toner particles in a semi-embedded state and has a rate of liberation of 0.1% by weight or less from the surface of the toner particle, wherein the small-particle diameter external additive has the rate of liberation of 0.5-3.0% by weight from the surface of the toner particle, the large-particle diameter external additive is contained in a range from 0.5-2 wt % based on the toner particle, and the small-particle diameter external additive is contained in a range from 0.4-3 wt % based on the toner particle.

2. The developer of claim 1, wherein the large-particle diameter external additive is stuck to the surface of the toner particles at 5 to 18% of a coating ratio.

3. The developer of claim 1, wherein the small-particle diameter external additive and/or large-particle diameter external additive is/are a silica fine particle treated using a silane coupling agent.

4. The developer of claim 1, wherein the toner particle is a colored resin particle having 1.5 to 1.9 $m^2/g$ of the BET specific surface area.

5. The developer of claim 1, wherein the large-particle diameter external additive has a number average particle diameter that is 2 to 12 times as many as that of the small-particle diameter external additive.

6. The two-component developer of claim 1, wherein the carrier is a resin coated carrier in which the surface of ferrite particles are coated with a resin layer and which has a volume average particle diameter of 20 to 60 μm.

7. The two-component developer of claim 6, wherein the resin layer is a thermosetting silicone resin layer.

* * * * *